US005483905A

United States Patent [19]

Johansson

[11] Patent Number: 5,483,905

[45] Date of Patent: Jan. 16, 1996

[54] SECURITY CABINET WITH DISPLAY WINDOW

[75] Inventor: Jerzy K. Johansson, Hässleholm, Sweden

[73] Assignee: Visual Security Visec Aktiebolag, Hassleholm, Sweden

[21] Appl. No.: 131,888

[22] Filed: Oct. 5, 1993

[30] Foreign Application Priority Data

Jan. 7, 1993 [SE] Sweden ..... 9300023

[51] Int. Cl.[6] ..... A47F 3/12

[52] U.S. Cl. ..... 109/79; 52/204.62; 52/780; 109/49.5; 109/80; 312/138.1; 312/140

[58] Field of Search ..... 109/2–5, 9, 10, 109/49.5, 58, 78–80; 52/780, 204.62, 204.67; 312/138.1, 140

[56] References Cited

U.S. PATENT DOCUMENTS

| | | | |
|---|---|---|---|
| 1,076,143 | 10/1913 | Miller . | |
| 1,146,415 | 7/1915 | Ekedahl | 312/140 X |
| 1,484,211 | 2/1924 | Erikson | 312/140 X |
| 2,969,268 | 1/1961 | Mason et al. | 312/140 X |
| 3,346,310 | 10/1967 | Diack | 312/140 |
| 3,544,181 | 12/1970 | Schottland | 312/114 |
| 3,630,814 | 12/1971 | Arnold et al. | 109/80 X |
| 4,090,755 | 5/1978 | Johnson | 312/140 X |
| 4,426,935 | 1/1984 | Nikoden, Jr. | 109/79 |
| 4,594,290 | 6/1986 | Fischer et al. | 109/80 X |
| 4,660,903 | 4/1987 | Shinagawa | 312/140 X |
| 4,747,644 | 5/1988 | Gallery et al. | 312/140 |

FOREIGN PATENT DOCUMENTS

| | | | |
|---|---|---|---|
| 626096 | 8/1927 | France | 312/140 |
| 1196168 | 11/1959 | France . | |
| 2516646 | 5/1983 | France | 109/78 |
| 209479 | 10/1908 | Germany | 109/80 |
| 3602539 | 7/1987 | Germany | 312/140 |
| 434967 | 8/1984 | Sweden . | |
| 456077 | 7/1968 | Switzerland . | |
| 354055 | 8/1931 | United Kingdom | 312/140 |

*Primary Examiner*—Lloyd A. Gall
*Attorney, Agent, or Firm*—Luedeka, Neely & Graham

[57] ABSTRACT

A security cabinet comprises a body of a high-strength material and at least one burglary resistant lockable door. To make the inventive cabinet sufficiently burglary resistant for storing e.g. firearms, it is designed with one main element and at least one end element attached to one end of the main element, at least one display window with a glass panel of shock-proof, burglary resistant glass sheet material being stationarily mounted in the body of the main element, whereas the burglary resistant, lockable door of the cabinet is attached to the body of the end element and forms at least part of the corresponding end wall of the cabinet. The display window is mounted by being clamped between a circumferential frame made of a high-strength material and arranged on the outside of the body, and a circumferential, torsionally rigid frame section on the inside of the body. The frame engages the body outside, and the frame section is attached to the body inside to form a mounting groove for the glass panel.

10 Claims, 4 Drawing Sheets

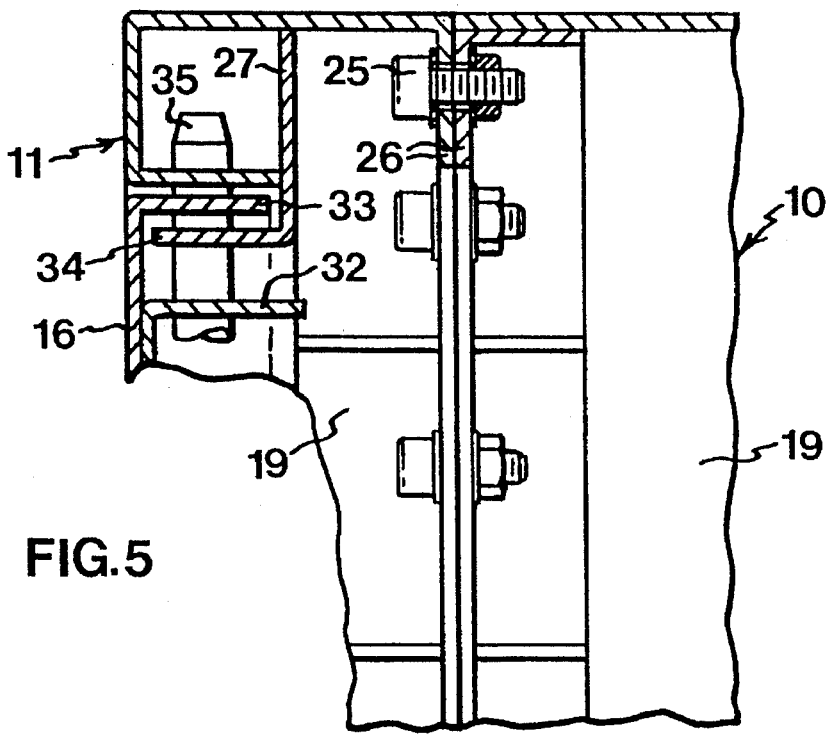
FIG.5
FIG.6
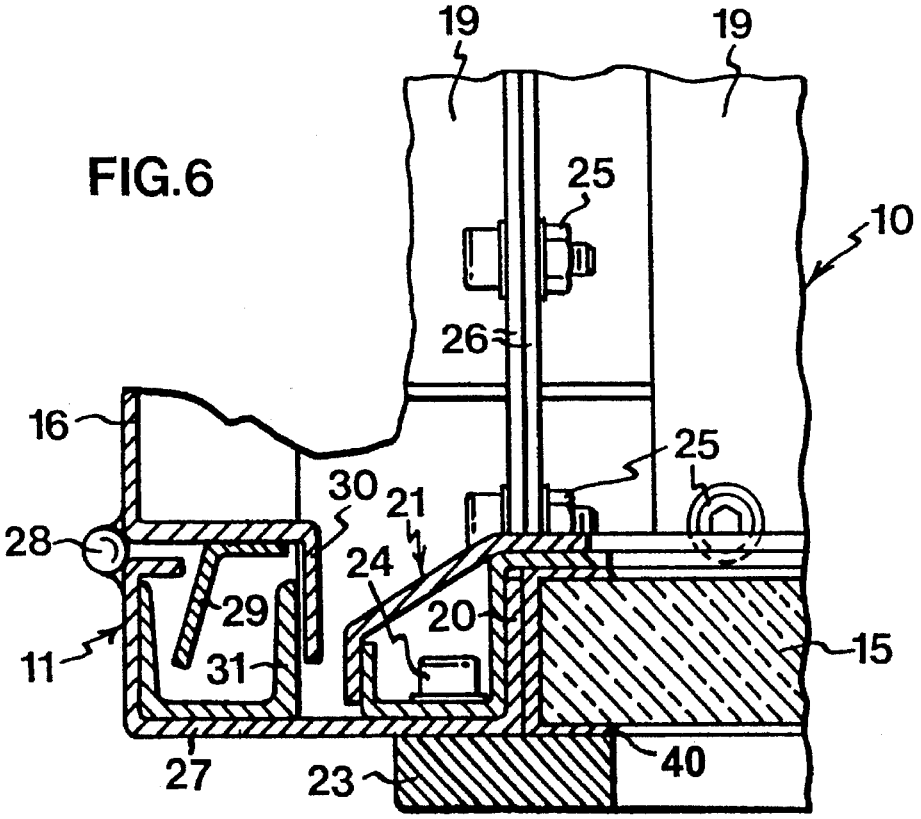

SECURITY CABINET WITH DISPLAY WINDOW

BACKGROUND OF THE INVENTION

The present invention relates to a security cabinet of the showcase type which permits display of objects stored in the cabinet with a minimum of theft risk. The cabinet is especially intended for the storing of goods and objects, firearms and jewelry, for which the theft risk is great.

When storing such objects, prior-art cabinets have proved not to be sufficiently burglary resistant to satisfy the requirements of the authorities concerning security cabinets for firearms. With regard to, inter alia, the matter of insurance, there is a need of security cabinets of the showcase type also for other articles that are especially liable to be stolen, for example in the goldsmith, watchmaking and computer business. By "showcase-type security cabinet" is meant, in this context, a cabinet having at least one glass panel through which the objects stored in the cabinet can be seen. Such showcases and/or cabinets approved for the storing of firearms in shops or at home are not available, as far as is known.

One object of the present invention therefore is to provide a security cabinet which satisfies these needs. A further object is to design a showcase so as to allow display of goods or objects, while maintaining such a security class that it can be used as a cabinet approved for storing firearms at home, at arms dealers' or in museums.

According to the invention, these and other objects are achieved if the security cabinet is designed as defined in claim 1. The subclaims define especially preferred embodiments of the invention.

SUMMARY OF THE INVENTION

Briefly, the problems with prior-art cabinets have been solved by the knowledge that the cabinet should be formed of a plurality of interconnected elements, viz. a main element and at least one end element. The display window or windows of shock-proof, burglary resistant glass sheet material is/are stationarily mounted in the body of the main element. The burglary resistant door is arranged in the free end wall of the end element, which constitutes a side wall of the cabinet. If desired, end elements can be attached to both ends of the main element to make the interior of the cabinet accessible from both ends. This arrangement renders it possible to use ordinary, approved security cabinets as end elements, by being made with an open back and an inwardly directed circumferential mounting flange which is connected, by screwing and/or welding, at least tack welding, to a similar mounting flange at the corresponding open end of the main element. The entire front and/or back of the security cabinet main element may be designed as a display window having a glass panel of shock-proof, burglary resistant glass sheet material by the main element having a body in which the glass panel of the display window is mounted by being clamped between a circumferential frame on the body outside and a circumferential, torsionally rigid frame section positioned on the body inside. The frame engages the body out side, and the frame section is attached to the body inside so as to form a mounting groove for the glass panel.

DESCRIPTION OF THE PRIOR ART

Swedish Patent Specification 8001302-2 (SE-B-434,967) discloses a cabinet which is made as a parallelepipedal box of steel sheet, the box having a door opening surrounded by a rigid, internal box section which is provided by folding the steel sheet of the box and which constitutes the door frame of the cabinet. The door of the cabinet is mounted in the box section by means of hinge pins extending into the corresponding hinge sleeves or holes in two opposite box sections in the cabinet door frame. This cabinet does not allow display of the objects stored therein.

U.S. Pat. No. 1,076,143 discloses a showcase which is readily mountable and dismountable and has a simple corner post construction for the front and end walls, display windows being inserted in the walls and having the shape of simple glass panels which are clamped between a mounting flange or groove which is made in one piece with the wall, and an externally mounted clamping strip or frame. This showcase is not designed in such a manner that it may be classified as a security cabinet.

U.S. Pat. No. 3,544,181 discloses a simplified showcase in which glass panels are mounted in extrusion formed plastic sections of an essentially rigid plastic material. The plastic sections are designed in such a manner that they can receive and yieldingly support the outer edges of the glass plates and neighboring parts of the fronts and backs of the glass panels, these plastic sections in turn being mounted in U-shaped metal sections forming the frame of the showcase. However, the construction cannot be classified as a security cabinet.

BRIEF DESCRIPTION OF THE INVENTION

The invention will now be described in more detail with reference to the accompanying drawings in which FIG. 1 is a perspective view of an embodiment of a security cabinet according to the present invention, FIG. 2 is a front view of this cabinet, FIG. 3 is a side view of the cabinet, as seen from the left in FIG. 2, FIG. 4 is a sectional view along line IV—IV in FIG. 2, FIG. 5 is a sectional view along line V—V in FIG. 3, FIG. 6 is a sectional view along line VI—VI in FIG. 3, and FIG. 7 is a sectional view corresponding to FIG. 4, of parts of a further embodiment of the security cabinet according to the invention.

DESCRIPTION OF THE PREFERRED EMBODIMENTS

Figure 1:
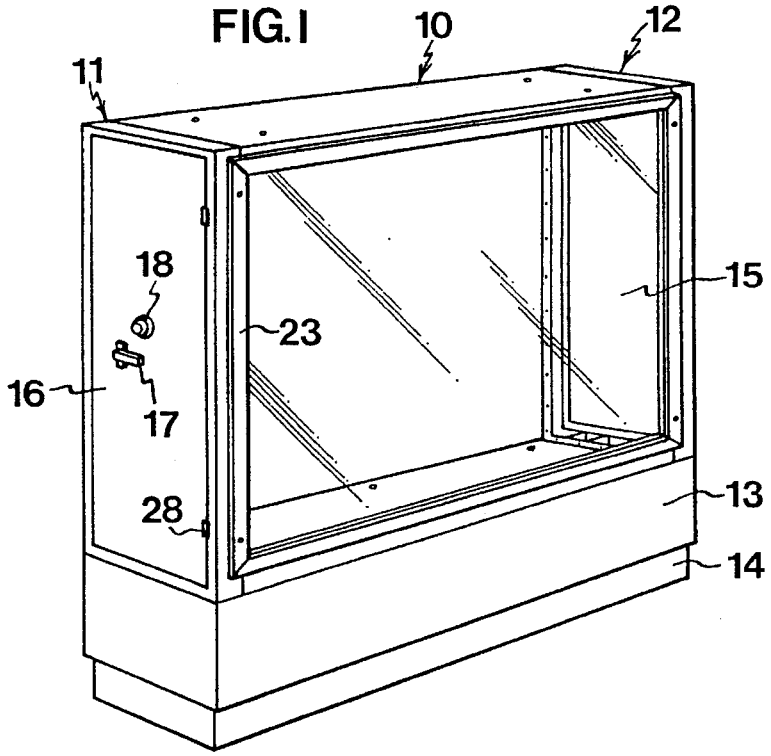
Figure 2:
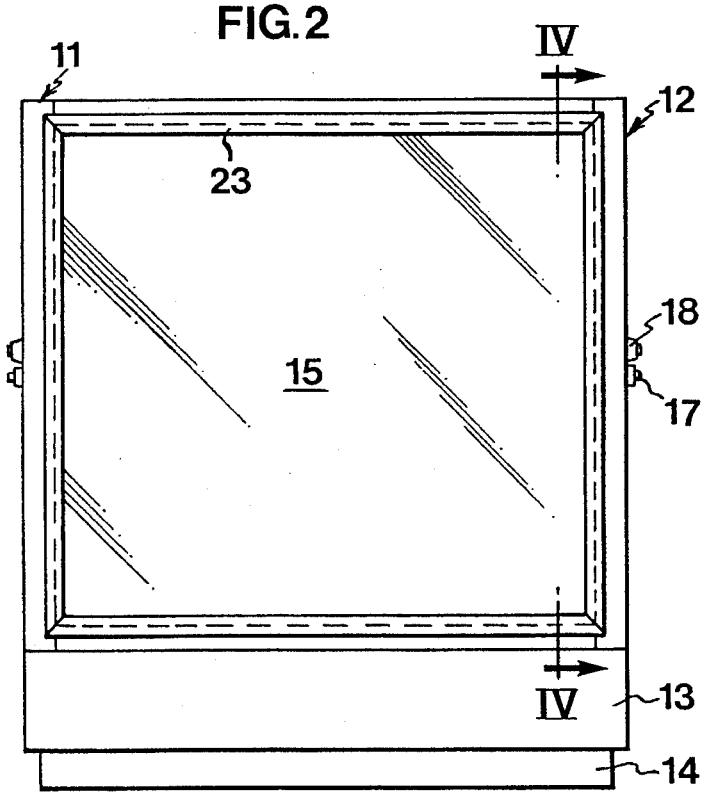

FIG. 1 is a perspective view of an embodiment of a security cabinet according to the invention. The security cabinet comprises one main element 10 and two end elements 11, 12. These three elements are mounted together and, besides, attached to a lower part 13 having a base 14.

In the embodiment shown, the main element 10 is formed with a front in the form of a display window 15. Each end element 11, 12 comprises a security door 16 with a handle 17 and a combination lock 18 or some other suitable lock.

Figure 4:
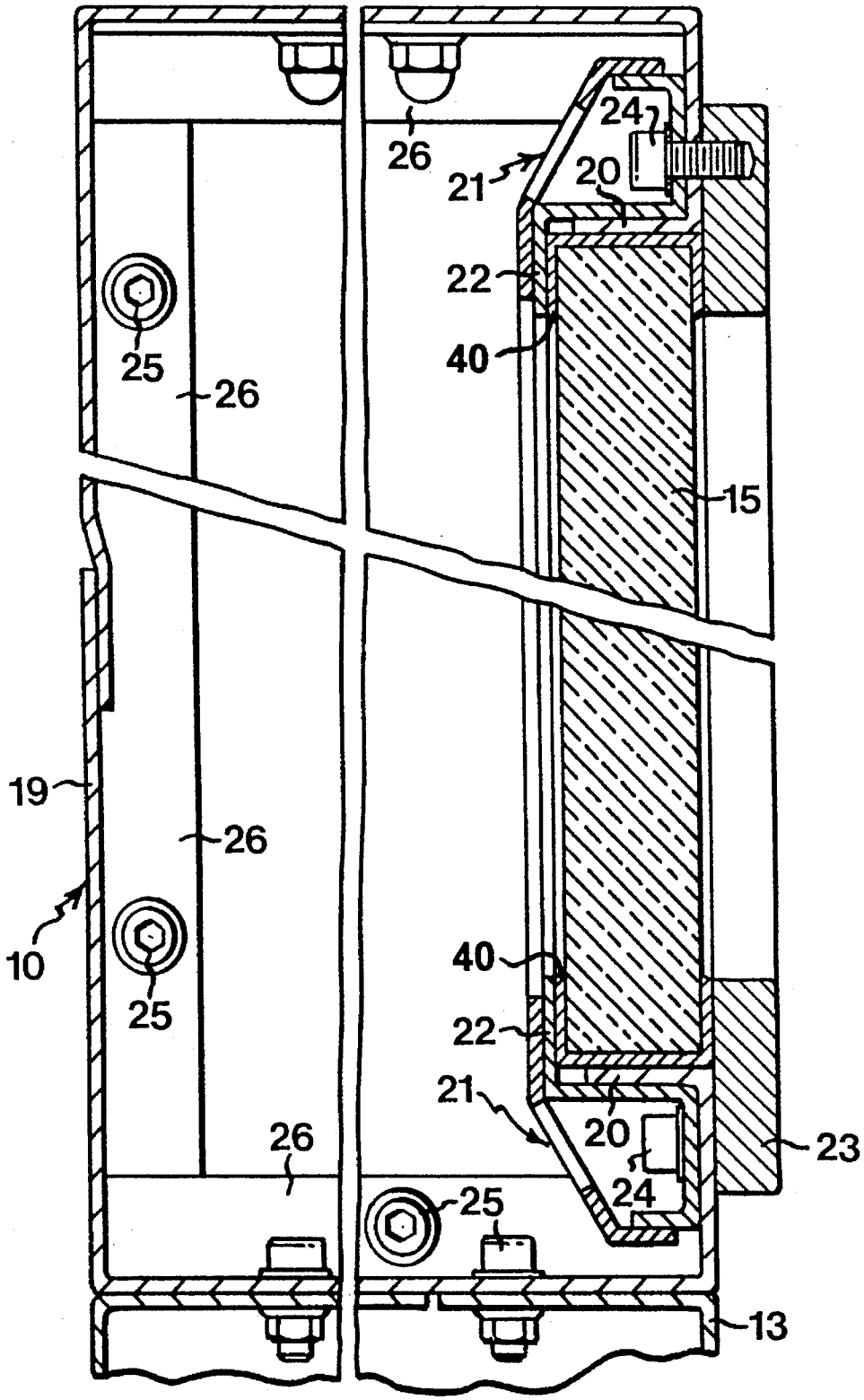

FIG. 4 is a sectional view of the cabinet main element 10 and a portion of the lower part 13. The main element and end elements of the cabinet comprise a body 19 of a high-strength sheet material, preferably steel sheet. In the embodiment shown, only one of the major sides of the main element is formed with a display window 15, and the back is in this case made of the same material as used for the body 19. Around the opening of the window glass panel 15 in the front of the main element there is fitted an inwardly directed stiffening flange 20 which in this case is integrated with the body 19. To form a mounting groove for the glass panel 15, which may have a thickness of e.g. 30 or 40 mm or more, use is made of a torsionally rigid frame section 21 which in the embodiment shown is trapezoidal in cross-section, thereby obtaining excellent torsional rigidity. At the inner edge of this frame section there is formed an inwardly directed clamping flange 22 which is adapted to form a mounting groove for the glass panel 15 with flange 20. The glass panel 15 is clamped between this clamping flange 22 and a frame 23 engaging the cabinet outside. This circumferential frame is attached by means of screws 24 which are screwed through the frame section and the material of the body 19 such that this and also the glass panel are clamped between the frame section 21 and the frame 23. The fact that the body 19 comprises the inwardly directed flange 20 and the frame section 21 encompasses this flange and besides is screwed to the body and the frame 23 results in excellent security against attempted burglary by using burglary tools in these areas of the cabinet. A sealing material 40 is, in conventional manner, inserted between the glass panel 15 and the clamping flange 22 as well as the frame 23, and also between the flange 20 and the circumferential edge of the glass panel.

FIG. 4 also shows that the main element 10 is screwed to the lower part 13 by means of screws 25. Of course, use can be made of tack welding or complete welding together, either instead of or supplementing the screw joint.

FIG. 4 also shows that the ends of the main element 10 are fitted with inwardly directed flanges 26 which permit assembly of the main element 10 and the two end elements 11, 12. Also this assembly may be effected by means of screws 25 and/or by tack welding or complete welding.

Figure 3:
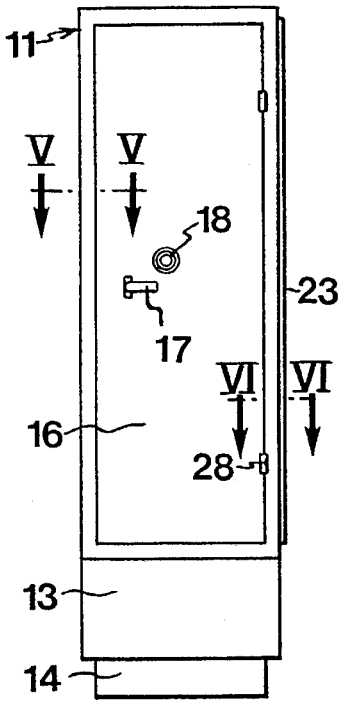

FIGS. 5 and 6 illustrate parts of two horizontal sectional views along the lines V—V and VI—VI, respectively, in FIG. 3. The two Figures illustrate how the main element 10 is screwed to the end element 11 by screws 25 being inserted through bores in the inwardly directed end flanges 26 on the main element 10 and the end element 11, respectively. As mentioned above, such screwing together may be supplemented with or replaced by tack welding or complete welding together of the flanges 26.

As is evident from the Figures, the end element 11 is designed as the front part of an ordinary security cabinet, i.e. it is made of a high-strength sheet material (preferably steel sheet) with reinforced corner areas 27 which form a square-section-like element. FIG. 6 illustrates how the security door 16 is hinged to the end element 11 by means of hinges 28, the door leaf 16 having at its terminal edge a projecting flange 29 which engages the open reinforced corner area of the body. Furthermore there is an outwardly directed flange 30 which engages behind the inwardly directed portion 31 of the corner area.

At the opposite side edge of the door, the door leaf 16 is formed with two inwardly directed flanges 32, 33 between which an outwardly directed flange 34 extends when the door is closed. The spring bolts 35 of the lock are inserted through these flanges 32, 33, 34 and into the square-section-like element of the corner area 27, when locking the door. If a burglar thus tries to burn off the hinges 28, it will not be possible to open the security door since the flanges 29 and 30 as well as the spring bolts 35 prevent this.

A great advantage of the invention is that one or both ends of the security cabinet is/are designed as a shortened, standard type security cabinet having an open back to be assembled with the main element 10 of the security cabinet designed according to the invention. This implies an essential rationalisation of the manufacture of cabinets. Furthermore, the main element may be optionally designed with security panels covering the entire front and possibly also the entire back and top of the cabinet main element.

The drawings do not illustrate the interior fittings of the security cabinet according to the invention. The fittings may be varied as requested and according to the type of article displayed. Of course, the inside and the metal sheet components of the security cabinet should be covered with some suitable coating material to provide an attractive appearance. Correspondingly, the end elements of the security cabinet may possibly be coated with wooden material or some other material if the security cabinet is to be used as a piece of display furniture at home. A great advantage of the invention is also that the end elements can be designed as standard type elements and be combined with main elements of different length according to the desired size of the showcase. Presently, a cabinet depth of about 550 mm is considered convenient, the end elements having a thickness of e.g. 110 mm, counted from the front of the door to the back of the inwardly directed flanges 26. The height of the cabinet may, of course, vary, but at present a height of 1500 mm is considered convenient. The main element may have different length, for instance 1000 mm, 1500 mm or 2000 mm, which at a depth of 110 mm of the end elements 11, 12 yields of a total length of 1220 mm, 1720 mm and 2220 mm, respectively, for the above-mentioned lengths of the main element 10. For these three sizes of the security cabinet according to the invention, the glass panels may be of a length of 992 mm, 1492 mm and 1992 mm, respectively, and a height of 1366 mm.

The circumferential frame 23 may be designed as a continuous frame, but may also be designed as four separate clamping strips having a cross-section of e.g. 20×60 mm at the stated dimensions of the security panels. In the embodiment according to FIGS. 1–6, the glass panel 15 is shown to be a homogeneous glass sheet, but preferably the glass panel is laminated, i.e. two or more individual glass sheets are interconnected by means of polycarbonate layers. The security panel may advantageously have alternate layers of glass material and layers of polycarbonate material for obtaining high impact resistance and high resistance to attempted burglary.

Figure 7:
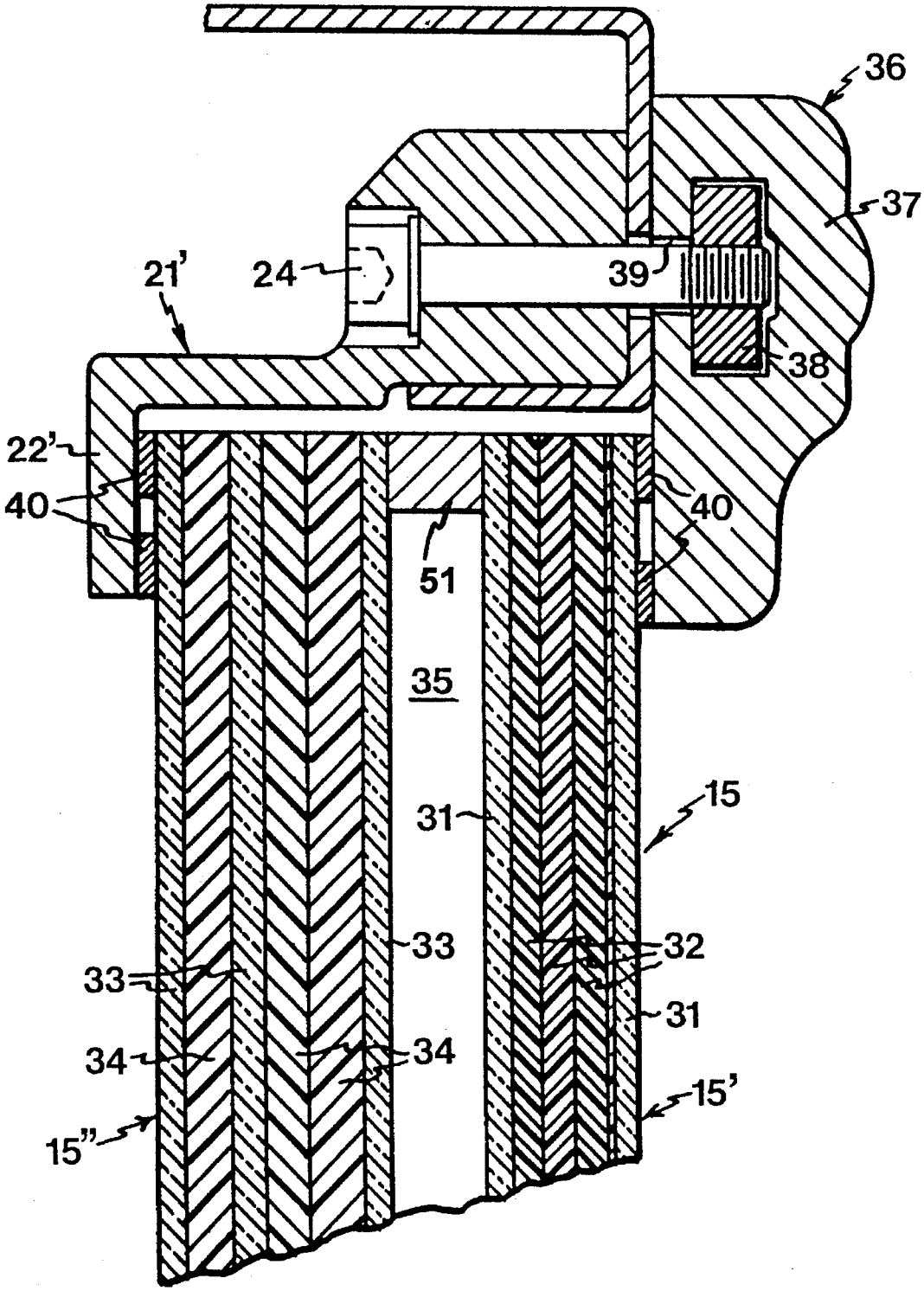

In the embodiment according to FIG. 7, the security window 15 is designed as a glass sheet unit in which two glass panels 15', 15" are spaced apart by means of inserts in the form of a circumferential spacing element 51 of, for instance, aluminum, the two glass panels being interconnected to form a sealed glazing unit. In this embodiment, the outer glass panel 15' is designed as a laminated panel with an outer layer 31 of glass material and an intermediate layer 32 of polycarbonate material. The inner glass panel 15" is formed of three layers 33 of glass material and three layers 34 of polycarbonate material. This design of the glass panel 15 yields an extremely high burglary resistance, since the air gap 35 between the two panels 15', 15" strongly obstructs the use of cutting tools for making a hole in the security window 15.

In the embodiment according to FIG. 7, the outside frame 36 is designed in a manner which is slightly different from the embodiment according to FIGS. 1–6. In this case the frame 36 comprises an extruded metal section 37 of e.g. aluminum or some other light metal material and a frame strip 38 of a high-strength material, preferably steel, which is inserted in this metal section. In the embodiment shown, the metal section 37 is formed as a U-section with an undercut groove for receiving the frame strip 38, the fixing screws 24 being inserted through the mouth 39 of the groove to be screwed into threaded holes in the frame strip 38.

In the embodiment according to FIG. 7, the torsionally rigid frame section 21', which is used to clamp the glass panel or glass sheet unit 15, is designed as an extruded section strip of steel or hardened aluminum or some other light metal material. The illustrated design of this frame section 21' with an inwardly directed clamping flange 22' results in high torsional rigidity.

Like in the embodiment according to FIGS. 1–6, an adhesive sealing material 40 is inserted in conventional manner between the glass panel 15 and the clamping flange 22' and the frame 36, respectively.

What I claim and desire to secure by Letters Patent is:

1. A security cabinet comprising:

a body (19) of a high-strength material;

a main element (10) having two opposite major sides;

a display window (15) in at least one of said major sides, said display window comprising a shock-proof, burglary resistant glass panel;

mounting means for mounting said glass panel in said main element, said mounting means comprising:

a circumferential, torsionally rigid frame section (21) attached to the inside of the body, said frame section being essentially trapezoidal in cross-section, and having at its inner edge an inwardly directed clamping flange (22) which is adapted to form part of a mounting groove for said glass panel (15), and a circumferential frame (23) of a high-strength material, engaging the outside of the body and adapted to clamp said glass panel between the frame section and the frame;

at least one end element (11, 12) attached to one end of said main element (10); and at least one burglary resistant, lockable door (16) attached to said end element.

2. Security cabinet as claimed in claim 1, wherein said frame section (21) of trapezoidal cross-section has a wide surface facing inwards; and wherein said clamping flange (22) is formed at one edge of said wide surface.

3. A security cabinet comprising:

a body (19) of a high-strength material;

a main element (10) having two opposite major sides;

a display window (15) in at least one of said major sides, said display window comprising a shock-proof, burglary resistant glass panel consisting of a glass sheet unit (15', 15") comprising at least two spaced-apart laminated glass sheets (15', 15");

mounting means for mounting said glass panel in said main element, said mounting means comprising:

a circumferential, torsionally rigid frame section (21) attached to the inside of the body, and a circumferential frame (23) of a high-strength material, engaging the outside of the body and adapted to clamp said glass panel between the frame section and the frame;

at least one end element (11, 12) attached to one end of said main element (10); and at least one burglary resistant, lockable door (16) attached to said end element.

4. Security cabinet as claimed in claim 3, wherein said laminated glass sheets (15', 15") of said glass sheet unit (15) comprise at least two sheets (31, 33) of glass and three sheets (32, 34) of polycarbonate, which sheets are laminated together such that both outer faces of said glass sheet unit (15) are formed of sheets (31, 33) of glass.

5. A security cabinet comprising:

a body (19) of a high-strength material;

a main element (10) comprising;

two opposite major sides, two ends, and inwardly directed flanges (26) on the ends;

a display window (15) in at least one of said major sides, said display window comprising a shock-proof, burglary resistant glass panel;

mounting means for mounting said glass panel in said main element, said mounting means comprising:

a circumferential, torsionally rigid frame section (21) attached to the inside of the body, said circumferential frame section (21) comprising, at its inner edge, an inwardly directed clamping flange (22) which is adapted to form part of a mounting groove for said glass panel (15), and a circumferential frame (23) of a high-strength material, engaging the outside of the body and adapted to clamp said glass panel between the frame section and the frame;

at least one end element (11, 12) having inwardly directed flanges which face the inwardly directed flanges (26) of said main element (10), said end element being interconnected to said main element (10) by means of said flanges; and at least one burglary resistant, lockable door (16) attached to said end element.

6. Security cabinet as claimed in claim 5, wherein said main element (10) is formed with an inwardly directed, circumferential stiffening flange (20) at the edge of said display window (15); and wherein said circumferential frame section (21) in its mounted state engages said stiffening flange (20) in such a manner that the clamping flange (22) of said frame section extends alongside said display window (15), thereby forming the mounting groove for said glass panel.

7. A security cabinet comprising:

a body (19) of a high-strength material;

a main element (10) comprising:

two opposite major sides, two ends, and inwardly directed flanges (26) on the ends;

a display window (15) in at least one of said major sides, said display window comprising a shock-proof, burglary resistant glass panel;

mounting means for mounting said glass panel in said main element, said mounting means comprising:

a circumferential, torsionally rigid frame section (21), essentially trapezoidal in cross-section, attached to the inside of the body, and a circumferential frame (23) of a high-strength material, engaging the outside of the body and adapted to clamp said glass panel between the frame section and the frame;

at least one end element (11, 12) having inwardly directed flanges which face the inwardly directed flanges (26) of said main element (10), said end element being interconnected to said main element (10) by means of said flanges; and at least one burglary resistant, lockable door (16) attached to said end element.

8. Security cabinet as claimed in claim 1, wherein said frame section (21) of trapezoidal cross-section has a wide surface facing inwards; and a clamping flange (22) formed at one edge of said wide surface.

9. A security cabinet comprising:

a body (19) of a high-strength material;

a main element (10) comprising;

two opposite major sides, two ends, and inwardly directed flanges (26) on the ends;

a display window (15) in at least one of said major sides, said display window comprising a shock-proof, burglary resistant glass panel, said shock-proof glass panel (15) consisting of a glass sheet unit (15', 15") comprising at least two spaced-apart laminated glass sheets (15', 15");

mounting means for mounting said glass panel in said main element, said mounting means comprising:

a circumferential, torsionally rigid frame section (21) attached to the inside of the body, and a circumferential frame (23) of a high-strength material, engaging the outside of the body and adapted to clamp said glass panel between the frame section and the frame;

at least one end element (11, 12) having inwardly directed flanges which face the inwardly directed flanges (26) of said main element (10), said end element being interconnected to said main element (10) by means of said flanges; and at least one burglary resistant, lockable door (16) attached to said end element.

10. Security cabinet as claimed in claim 9, wherein said laminated glass sheets (15', 15") of said glass sheet unit (15) comprise at least two sheets (31, 33) of glass and three sheets (32, 34) of polycarbonate, said sheets being laminated together such that both outer faces of said glass sheet unit (15) are formed of sheets (31, 33) of glass.

* * * * *

UNITED STATES PATENT AND TRADEMARK OFFICE

CERTIFICATE OF CORRECTION

PATENT NO. : 5,483,905

DATED : January 16, 1996

INVENTOR(S) : Jerzy K. Johansson

It is certified that error appears in the above-indentified patent and that said Letters Patent is hereby corrected as shown below:

Column 1, line 8, after "objects", insert -- e.g. --

Column 5, line 67, delete "which" and insert -- said --.

Column 5, line 67, delete "are" and insert -- being --.

Column 5, line 41, delete "wherein" and insert -- a --.

Column 5, line 42, after (22) delete "is".

Signed and Sealed this

Ninth Day of July, 1996

*Attest:*

*Attesting Officer*

BRUCE LEHMAN

*Commissioner of Patents and Trademarks*